United States Patent [19]

Collins et al.

[11] Patent Number: 4,580,501

[45] Date of Patent: Apr. 8, 1986

[54] REMOVING ELASTIC RAIL FASTENERS

[75] Inventors: John L. Collins, South Australia; Wally A. Remes, Redwood Park, both of Australia

[73] Assignee: Ralph McKay Limited, Maidstone, Australia

[21] Appl. No.: 482,785

[22] Filed: Apr. 7, 1983

[30] Foreign Application Priority Data

Apr. 7, 1982 [AU] Australia ..... PF3526

[51] Int. Cl.[4] ..... B61D 17/00

[52] U.S. Cl. ..... 104/1 R; 104/17 A

[58] Field of Search ..... 104/1 R, 17 R, 17 A, 104/2, 9, 15; 238/349; 29/252; 294/106; 414/738, 739

[56] References Cited

U.S. PATENT DOCUMENTS 2,959,444 11/1960 Callender ..... 294/106
3,257,144 6/1966 Gardner ..... 294/106
3,438,523 4/1969 Vik ..... 294/106
4,068,593 1/1978 Leeves ..... 104/1 R
4,319,392 3/1982 Cutts ..... 104/1 R
4,367,682 1/1983 Freilich ..... 104/17 A

*Primary Examiner*—Robert B. Reeves
*Assistant Examiner*—Dennis C. Rodgers
*Attorney, Agent, or Firm*—Christel, Bean & Linihan

[57] ABSTRACT

Apparatus for removing elastic rail fasteners of the kind that are applied transversely of the rail. The apparatus removes two fasteners simultaneously from a rail seat. The apparatus comprises a carrier frame (10) having a pair of opposed abutment plates (14 and 15) which move arcuately parallel to the rail (12). Associated with each plate (14 or 15) is an extraction lever (26*a* and 26*b*) which moves arcuately transverse to the rail. The abutment plates align the apparatus with the fastener (40), compress the arms (44) of the fastener (40) and the extraction levers (26*a* and 26*b*) pull the fasteners (40) from the rail seat.

6 Claims, 7 Drawing Figures

REMOVING ELASTIC RAIL FASTENERS

This invention relates to apparatus and a method for removing elastic rail fasteners from the mounting shoulder on the rail tie.

In particular it is concerned with fasteners that are applied in a direction parallel to the rail tie and at right angles to the rail.

For a pair of rails each tie accommodates four fasteners (two to a rail) which are held in position by support shoulders embedded or secured to the rail tie. Each pair of support shoulders are located on opposite sides of a rail which lies between them. Insulator pads are placed on the rail flange to insulate the rail from the support shoulders and the fastener. The fastener when in position is held by the support shoulder and one end lies on the rail flange imparting a holding down force.

The rail fasteners and support shoulders are preferably those described in Australian Patent specification Nos. 37379/78, 47881/79, 54004/79 and 60581/79. The fasteners and shoulder described in Australian Patent specification Nos. 45550/79, 47039/79, 53946/79 and 63504/80 are also suitable for use with this invention.

The rail fastener of the above type is held in position on the rail either because the free ends of the clip abut against upstanding portions of the shoulder which are parallel to the rail or the clip is provided with a groove or recess that clips over a complementary bead or flange in the support shoulder. In applying the fasteners of the first kind the free ends are compressed toward each other to pass through a gap between said upstanding portions and spring apart to be held securely in contact with said rail flange. In the second type the rail clip snaps into its rail fastening position and is held there.

Difficulty has been encountered in removing fasteners of this kind because it is not possible to simply pull them off the rail flange or support shoulder. Further it is desirable, but hitherto it has not been possible to remove at least two fasteners simultaneously to enable a rail to be freed and removed.

Rail fastener removal apparatus is known for other types of rail clips. U.S. Pat. No. 3,690,264 (Plasser and Theurer) discloses a machine for removing rail spikes which provides a pivoted hydraulic arm carrying a hook which is adapted to contact the spike to be removed and then lift it out of the rail tie. U.K. Pat. No. 2,027,778 discloses apparatus for removing "Pandrol" clips which are applied and removed in a direction parallel to the rail. The clips are removed by application of pressure from a pivoted arm. Both the above devices are carried by a frame mounted for movement on the rails themselves.

It is an object of this invention to improve the method of changing rails by providing means for simultaneously removing fasteners of which are applied at right angles to the rail and parallel to the rail tie.

To this end the present invention provides a rail fastener removal apparatus comprising a carrier frame adapted to extend transversely of a rail, said frame carrying at each end a pair of opposed abutment faces pivoted for movement parallel to the rail and an extraction lever associated with each abutment face said extraction levers being pivoted for movement at right angles to said rail.

This apparatus is operated in two basic movements. The first is for the abutment faces to contact the edges of the arms of the rail fastener and either compress them or depress them and the second is for the extraction lever to engage the curved portion of the fastener arms and push the fasteners away from the rail. In removing rail clips of the first mentioned kind, compressing the arms of the free ends enables them to pass through the gap between the upstanding portions of the support shoulder. Similarly depression of the rail clip arms enables the clips of specification Nos. 47309/79; 45550/79; 63504/80 to be clear of the locking bead and can subsequently be extracted.

Preferably the inward movement of the abutment faces is controlled to ensure equal compression or depression to each side of the fastener. By ensuring that the abutment faces are shaped to contact the support shoulder when a predetermined compression or depression of the arms (measured by inward or downard deflection) has occured, this even compression can be assured.

Similarly the movement of pairs of opposed extraction levers are linked. Using hydraulics and an appropriately set pressure sensing valve the extraction levers will commence to move after the abutment faces have fully compressed the fastener arms.

One preferred embodiment of the invention will now be described with reference to the drawings in which:

Figure 1:
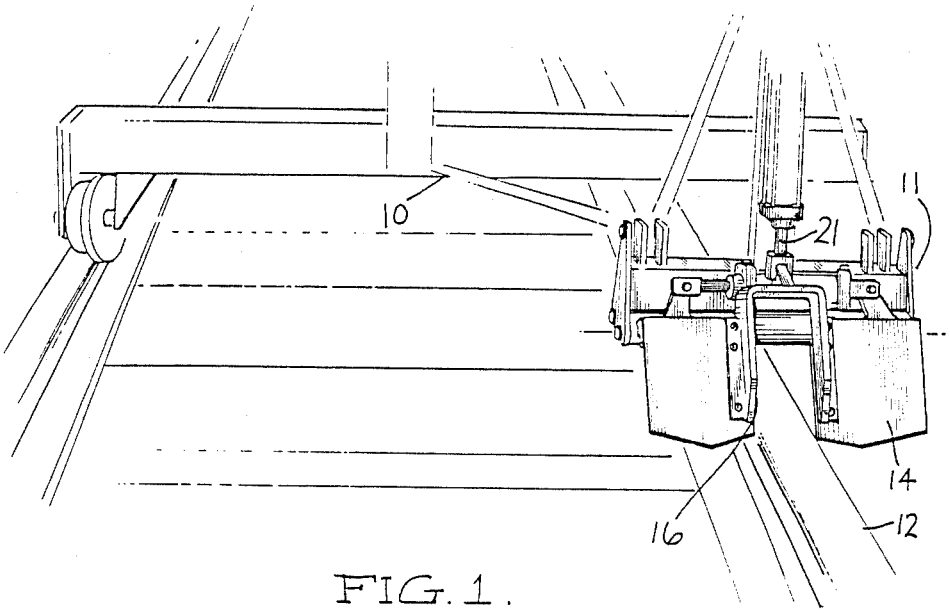
FIG. 1 is a front view of the rail clip extractor.
Figure 2:
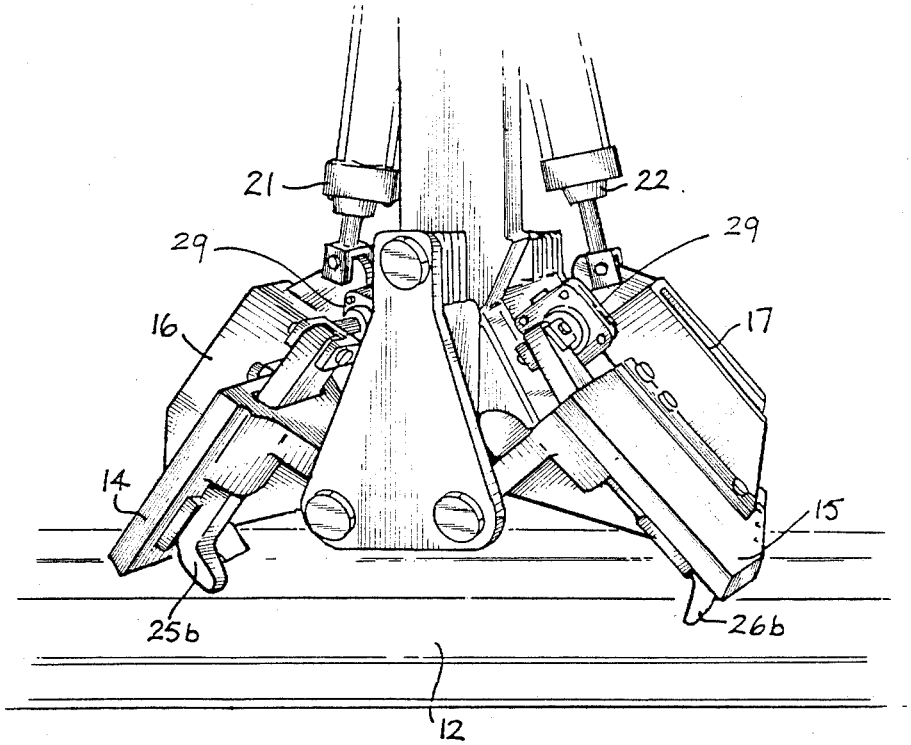
FIG. 2 is a side view.

The extractor comprises a frame 10 mounted for wheeled movement on rails as shown schematically in FIG. 1. The extractor mechanism 11 as shown is mounted for carriage over one rail 12 and comprises a pair of opposed abutment plates 14 and 15 which are of identical structure, and each of which incorporates a rail clearance channel 16 and 17 respectively. The abutment plates 14 and 15 are pivoted along axles 18 and 19 for accurate movement parallel to rail 12. The independently hydraulicly operated driving arms 21 and 22 pivotally connected at points **21*a* and 22*a* to the plates 14 and 15** control the movement of those plates.

Figure 3:
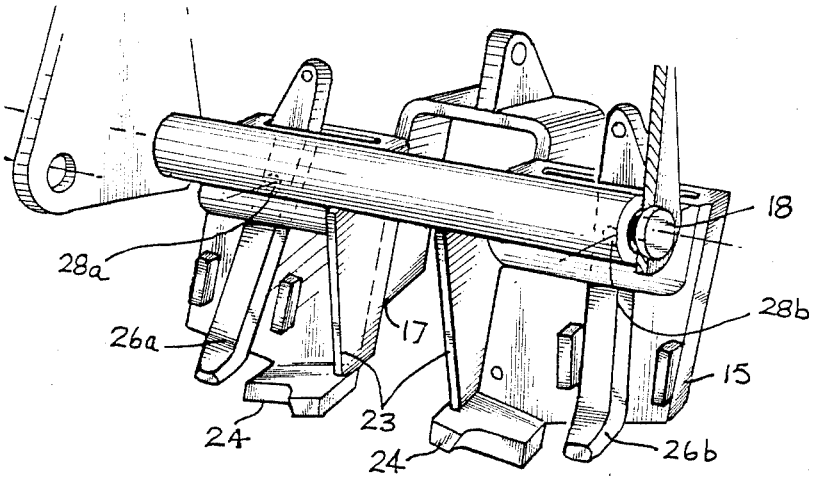
FIG. 3 is front view of one side only of the extractor.
Figure 4:
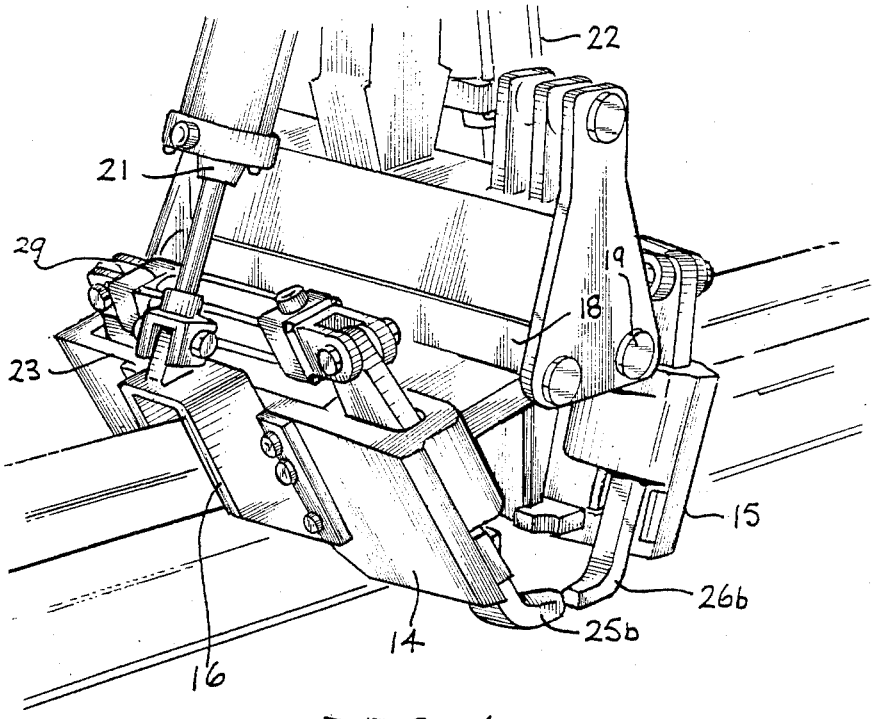
FIG. 4 is a perspective view of the closed extractor.

In FIG. 3 a front view of plate 15 depicts the support webs 23 located adjacent the rail clearance channel 17. At the base of the support webs 23 is the rail clip compression/shoulder abutment flange 24 which is shaped to conform to the insulator contact surface of the clip and support shoulder adjacent the rail 12.

Figure 5:
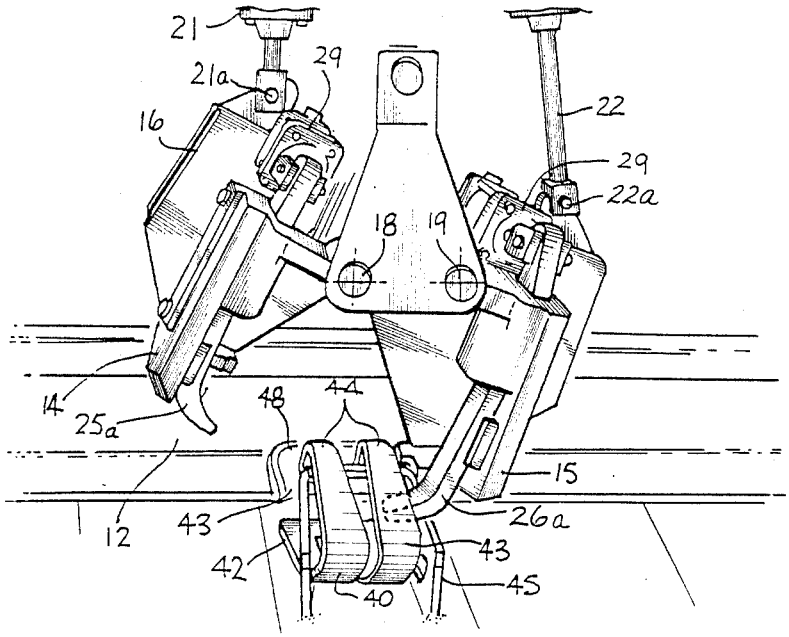
FIG. 5 is a side view of the extractor in its first contact position with a rail anchor seat.
Figure 6:
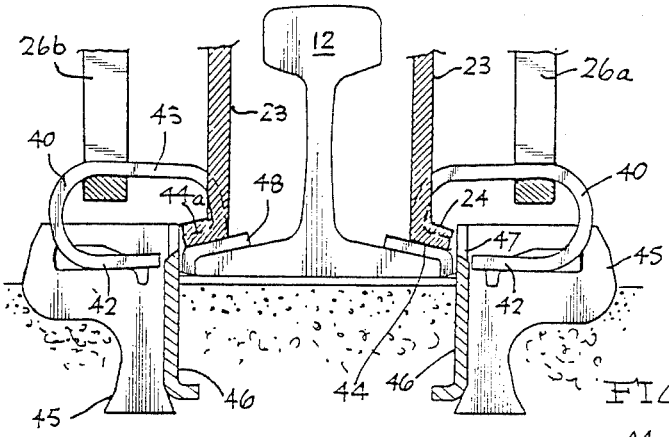
FIG. 6 is a sectional view along the rail of the extractor in contact with the rail anchor seat.
Figure 7:
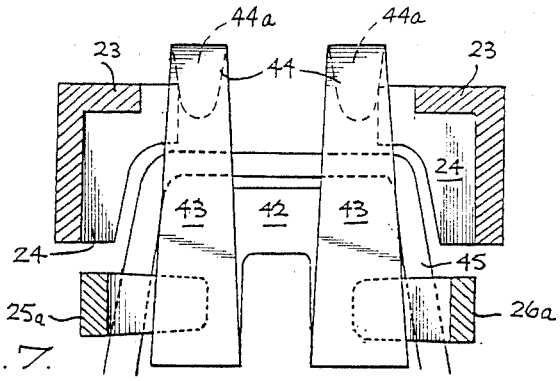
FIG. 7 is a plan view of one rail clip and shoulder in abutment with the extractor.

As shown in FIGS. 5, 6 and 7 the rail seat comprises a rail clip 40 having a base portion 42 seated in the support shoulder 45 and two curved arms 43 whose ends 44 having lower portions **44*a* lie on the rail insulators 48 which in turn is located on the base flange of rail 12. The face 46 of the support shoulder 45 incorporates a shallow cut out channel 47 through which the laterally compressed arms 43 of the clip may pass but which is generally of less width than the external width of the two ends 44 of the clip 40**.

Returning to FIG. 3 the lever arms **26*a* and 26*b* are mounted for simultaneous oposite pivotal movement about pivot points 28***a* and 28*b*. Each pair of pivot arms 25*a*,25*b* and 26*a*,26*b* are simultaneously operated by hydraulic pressure and each of the levers 25*a* and 26*a* are connected by hydraulic rams 29 to its complementary lever 25*b* and 26*b*. Contraction of the hydraulic rams 29 results in outward movement of the flanged lower end of each of the levers 25*a*, 25*b*, 26*a* and 26*b*.

In operation the extractor mechanism is initially brought into contact with a rail seat as shown in FIG. 5. The first point of contact (best illustrated in FIG. 7) is between the compression flange 24 of the abutment plates 14 and 15 and the clip ends 44 of the rail clip 40. Once abutment plate 15 is in final position the second compression flange is brought into contact as depicted in FIGS. 6 and 7. At this stage both the lower portions 44*a* of the ends 44 of the rail clip are contacted by the compression flange 24 and the flanged ends of the lever arms 25*a*, 25*b*, 26*a* and 26*b* beneath the upper poriton of the curved arms 43 of the rail clip 40 as depicted on FIGS. 5, 6 and 7.

The third stage is the continued inward movement of the abutment plate 14 so that the compression flanges 24 compress the clip ends 44 together until the cylinder 21 runs out of stroke and the shoulder abutment flanges 24, almost contact the support shoulder 45. The dimensions of the rail clip compression/shoulder abutment flanges 24 are chosen to ensure that sufficient compression of the rail clip ends 44 occur so that they are able to pass through the channel 47 of the face 46 of the support shoulder 45.

When inward movement of the abutment plate 14 is supported by the end of stroke of cylinder 22, the hydraulic pressure is automatically switched to contract the rams 29 so that the flanged ends of the levers 25*a*, 25*b*, 26*a* and 26*b* move outwards away from rail 12, to contact the curved portion of arms 43 of the rail clip 40 with the result of withdrawing the clip 40 from the support shoulder 45. This operation effectively removes a pair of rail clips from both sides of a rail in one operation. Where both rails are to be replaced the extractor mechanism can be carried over both rails. However as illustrated in this embodiment it is conventional to replace rails singly.

It can be seen from the above that the present invention provides an effective means for removing rail clips, which are mounted at right angles to the rail. Removal of the clips is achieved with minimum risk of damaging fasteners or the rail tie. Further, two clips disposed on either side of a rail can be removed in one operation.

We claim:

1. A rail fastener removal apparatus comprising a carrier frame adapted to extend transversely of a rail, said frame carrying at each end a pair of opposed abutment faces each having a pivot for movement parallel to the rail and an extraction lever located adjacent to each abutment face, said extraction levers each having a pivot for movement at right angles to said rail and said levers each engaging a rail fastener so as to remove said fastener transversely from said rail.

2. Apparatus as claimed in claim 1 wherein each said pair of opposed abutment faces is moved about its pivot by an hydraulic ram and the pressure applied to a pair of rams operatively associated with a pair of opposed abutment faces is equalized between the rams.

3. Apparatus as claimed in claim 1 wherein abutment faces are located on either side of a rail and for each pair of abutment faces which move in the same direction there is a common hydraulic ram to control such movement.

4. Apparatus as claimed in claim 3 wherein for each pair of abutment faces which move in the same direction the ends spaced from the pivots of the extraction levers adjacent each abutment face are connected by a single hydraulic ram to move said levers in unison.

5. Apparatus as claimed in claim 1 mounted on a mobile rail car for positioning over a rail.

6. Apparatus as claimed in claim 1, wherein each fastener comprises a pair of arms extending generally transversely to said rail, and wherein each said pair of opposed abutment faces is moved about its pivot by motive means to contact and move said fastener arms.

* * * * *